United States Patent [19]

Heubeck

[11] 4,019,778

[45] Apr. 26, 1977

[54] DENTAL PATIENTS' CHAIR WITH A PARALLELOGRAM SUPPORTING ARM

[75] Inventor: Erich Heubeck, Bensheim, Germany

[73] Assignee: Siemens Aktiengesellschaft, Munich, Germany

[22] Filed: May 30, 1975

[21] Appl. No.: 582,163

Related U.S. Application Data

[63] Continuation of Ser. No. 407,257, Oct. 17, 1973, abandoned.

[30] Foreign Application Priority Data

Oct. 21, 1972 Germany ..... 2251809

[52] U.S. Cl. ..... 297/346; 248/421

[51] Int. Cl.[2] ..... A47C 3/20

[58] Field of Search ..... 297/330, 344–348, 297/285, 294, 295; 248/19, 346, 419, 421; 29/463

[56] References Cited

UNITED STATES PATENTS

| | | | |
|---|---|---|---|
| 1,658,456 | 2/1928 | Meyer | 248/346 |
| 2,287,182 | 7/1942 | Leake | 29/463 X |
| 2,690,786 | 10/1954 | Sedlock | 297/285 X |
| 2,784,768 | 3/1957 | Holopainen | 248/419 X |
| 3,083,055 | 3/1963 | Davis | 297/345 |
| 3,302,971 | 2/1967 | Lory | 297/346 |
| 3,482,871 | 12/1969 | Lehner | 297/325 |
| 3,493,201 | 2/1970 | Marran | 248/346 X |
| 3,694,990 | 10/1972 | Pamer | 29/463 X |

FOREIGN PATENTS OR APPLICATIONS

| | | | |
|---|---|---|---|
| 1,941,303 | 2/1971 | Germany | 297/347 |
| 1,927,567 | 12/1970 | Germany | 297/330 |

*Primary Examiner*—Marion Parsons, Jr.
*Assistant Examiner*—William E. Lyddane
*Attorney, Agent, or Firm*—Allison C. Collard

[57] ABSTRACT

A dental patients' chair with two parallelogram supporting arms, each having one end linked to a base and another end carrying the seat of the chair. The invention is particularly characterized in that the base is a welded construction consisting substantially of a horizontal basic part and two spaced welded vertical side walls receiving link axles of an end of the parallelogram arms.

3 Claims, 2 Drawing Figures

DENTAL PATIENTS' CHAIR WITH A PARALLELOGRAM SUPPORTING ARM

This invention is a continuation of a patent application Ser. No. 407,257, filed Oct. 17, 1973, now abandoned.

This invention relates to a dental patients' chair with two parallelogram supporting arms each having an end linked to a base and another end carrying the seat of the chair.

The comparatively heavy weight to which such a parallelogram is subjected requires a very stable base construction which should be rigid against all twisting. In known patients' chairs the base consists of a cast part which must have great wall thicknesses to be able to receive safely the required comparatively large carrying forces. This base is therefore heavy, so that there are often transportation and mounting difficulties. This is particularly so since the parallelogram carrying arms with their adjusting means must be first placed upon the base for functioning and mounting. It is therefore necessary to provide special stable moving means as well as special transporting groups in order to bring such a chair to its customer, so that the total transportation and mounting costs are greatly increased.

An object of the present invention is the provision of a dental patients' chair of the described type which does not have the above-mentioned transporting and mounting problems and wherein there is also a saving of costs in the manufacture of the chair.

In the accomplishment of the objectives of the present invention it was found desirable to make the base of a welded construction as consisting substantially of a horizontal basic part and two spaced welded vertical side walls receiving link axles of an end of each parallelogram arm.

This suggested welded construction for the base not only diminishes the weight of the chair without a loss of its rigidity but also has the great manufacturing advantage consisting in that after the separate parts have been welded together it is not necessary to carry out any additional work, such as milling or polishing. The side walls can be covered by simple and cheaply made covering parts.

According to an advantageous embodiment the basic part consisting of a flat elongated sheet box, produced by a joint welding of a flat plate with edge parts of a box-like shaped cover. The hollow space in the box can be stiffened by struts extending substantially parallel to the longitudinal sides of the plate. Profiled ledges produced preferably in a bending process can be used as struts which are welded on the one hand to the plate and on the other hand to the cover. The profiled ledges can consist of sheet strips which are U-shaped in cross-section and have rectangularly bent ends. It is advantageous to make the side walls of two welded half pans.

In accordance with another advantageous embodiment of the present invention a particularly simple and inexpensive manufacture of the base is produced if the basic part consists of a plate and a frame welded to the plate and consisting of hollow profiled tubes with preferably rectangular cross-section. The side walls are also preferably made of such hollow profiles by welding together several struts.

The invention will appear more clearly from the following detailed description when taken in connection with the accompanying drawings showing by way of example only, preferred embodiments of the inventive idea.

Figure 1:
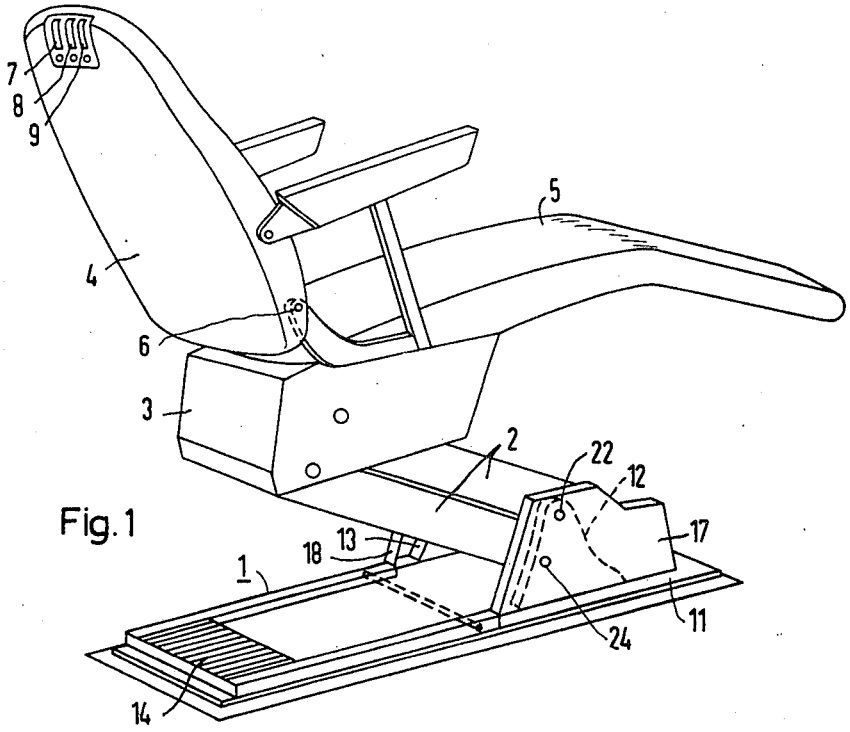
FIG. 1 is a perspective view of a dental chair.
Figure 2:
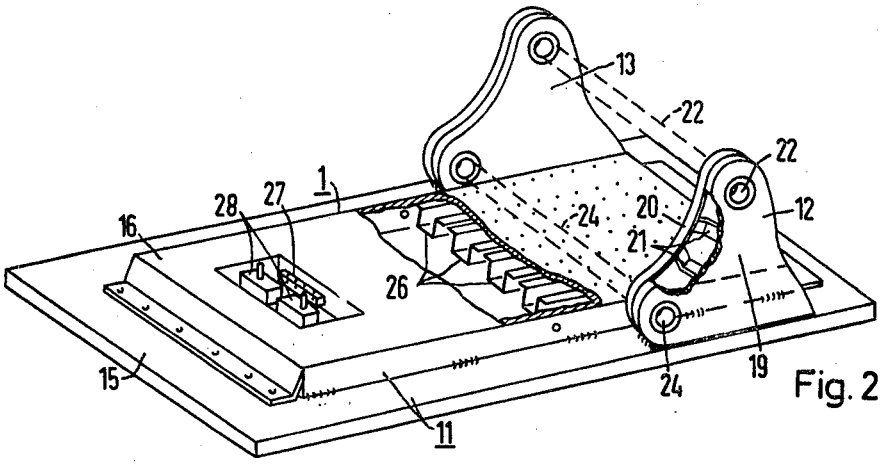
FIG. 2 is a perspective view of the base of the chair.

FIG. 1 shows a dental patients' chair having a base 1 to which the parallelogram carrying arms 2 are connected. A support 3 is arranged at the free end of the arm and carries the chair's upper part consisting substantially of the back 4 and the seat 5. The back 4 can be inclined about the axis 6 relatively to the seat 5 and the seat 5 can be tipped relatively to the carrier 3 about an axis also extending transversely to the longitudinal axis of the chair which is not shown in the drawing. The three adjusting movements, namely, the inclination of the back, the tipping of the seat and the height adjustment of the upper part of the chair are actuated by means of the parallelogram carrying arms by actuating members 7 to 9 provided upon the back 4. The actuating members 7 to 9 are located upon the upper part of the back 4 and are so arranged that they can be operated from the back surface of the back as well as from its upper side. The back is made very thin so as to provide a sufficient freedom of foot movement for the seated person in the lower chair position when the back is substantially vertical. In order to avoid extending parts the actuating members 7 to 9 are embedded in the chair back.

The base 1 consists substantially of a bottom part 11 upon the front portion of which on opposite sides are provided two vertical sides pieces 12, 13 in which the parallelogram arms 2 are swingably mounted. The side pieces 12, 13 are covered by removable covering sheets 17, 18. The parallelogram 2 can be moved from the illustrated position into a deep position in which the arms extend substantially horizontally. In the back part of the bottom 11 there is a stepping plate 14 which is swingably mounted and which cooperates with switching members in the base 11 in such manner that when the plate 14 is stepped on the drive for moving the parallelogram 2 is switched off. This arrangement serves for the safety of the operator if by mistake an object (foot of the operator or chair) reaches into the moving range of the carrier 3 or the parallelogram arms 2 during the downward movement of the chair.

The base 1 consists of a welded structure formed by a plate 15 which can be fixed to the floor, a box-shaped cover 16 and side pieces 12, 13 welded on both sides of the part 16 to the plate 15. Each of the side pieces 12, 13 consists of two half shells 19, 20 welded to each other and held by space supports 21. The half shells are made of sheet metal (drawn or pressed part). Bushings supporting the bearing axles 22 and 24 of the parallelogram arm are welded in the half shells 19, 20. The cover 16 is made of a sheet plate by suitable cutting and edge forming. Within the box which is thus formed there are provided sheet profiles 26 which are welded both to the cover 16 and to the plate 15 and extend parallel to the longitudinal sides of the base plate. The sheet profiles are also produced in a bending process. At its rear end the cover 16 has a recess which forms with the base plate 16 an open box 27 containing two switches 28 as well as different electrical connecting parts. The switches 28 are actuated by the stepping plate 14 shown in FIG. 1.

I claim:

1. A dental patients' chair, comprising a base having a horizontal substantially rectangular base part consist-

United States Patent [19]

Hogan

[11] 4,019,779

[45] Apr. 26, 1977

[54] LAMINATED ARMREST

[75] Inventor: Gerard T. Hogan, Southington, Conn.

[73] Assignee: Universal Oil Products Company, Des Plaines, Ill.

[22] Filed: Sept. 8, 1975

[21] Appl. No.: 611,475

Related U.S. Application Data

[62] Division of Ser. No. 537,482, Dec. 30, 1974, abandoned.

[52] U.S. Cl. ..... 297/411; 297/414

[51] Int. Cl.[2] ..... A47C 7/54

[58] Field of Search ..... 297/412, 414, 416, 115, 297/422, 227, 232; 5/361 B, DIG. 2

[56] References Cited

UNITED STATES PATENTS

| | | | |
|---|---|---|---|
| 2,524,659 | 10/1950 | Gorman | 297/414 |
| 2,804,125 | 8/1957 | Adams | 297/414 |
| 3,124,390 | 3/1964 | Eames et al. | 297/232 X |
| 3,362,749 | 1/1968 | Clement | 297/412 |
| 3,400,979 | 9/1968 | James | 297/412 |
| 3,893,729 | 7/1975 | Sherman et al. | 297/232 X |

FOREIGN PATENTS OR APPLICATIONS

| | | | |
|---|---|---|---|
| 906,265 | 9/1962 | United Kingdom | 5/361 B |

*Primary Examiner*—Ramon S. Britts
*Assistant Examiner*—Darrell Marquette
*Attorney, Agent, or Firm*—James R. Hoatson, Jr.; Barry L. Clark; William H. Page, II

[57] ABSTRACT

Laminated cushion formed of a plurality of alternating, relatively rigid and relatively soft layers of resilient foam has a higher compression rate in the direction of an axis parallel to the planes of the layers than in the transverse direction. Thus, when the cushion is positioned with the planes of the layers arranged vertically, the cushion is usable as an armrest. When it is positioned with the planes of the layers arranged horizontally, it is usable as a pillow. In a modification, the cushion can be added to the side of a conventional armrest on an aircraft passenger seat to increase the width thereof while being easily compressed sideways to accommodate larger framed passengers.

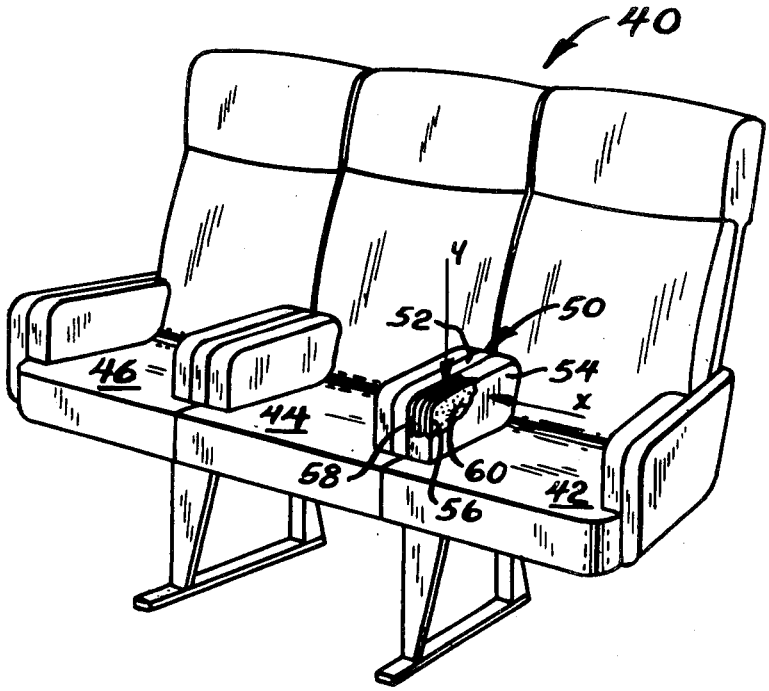

1 Claim, 4 Drawing Figures